US011810694B2

(12) United States Patent
Zymelka

(10) Patent No.: US 11,810,694 B2
(45) Date of Patent: Nov. 7, 2023

(54) ELECTRICAL CABLES

(71) Applicant: Zytech LTD, Colchester (GB)

(72) Inventor: Antony Zymelka, Colchester (GB)

( * ) Notice: Subject to any disclaimer, the term of this patent is extended or adjusted under 35 U.S.C. 154(b) by 0 days.

(21) Appl. No.: 17/647,586

(22) Filed: Jan. 10, 2022

(65) Prior Publication Data

US 2022/0139596 A1 May 5, 2022

Related U.S. Application Data

(63) Continuation-in-part of application No. 15/779,812, filed as application No. PCT/GB2016/053756 on Nov. 30, 2016, now abandoned.

(51) Int. Cl.

| | |
|---|---|
| ***H01B 3/02*** | (2006.01) |
| ***H01B 7/28*** | (2006.01) |
| ***H01B 11/22*** | (2006.01) |
| ***H01B 13/012*** | (2006.01) |

(52) U.S. Cl.

CPC ..... *H01B 7/2806* (2013.01); *H01B 3/02* (2013.01); *H01B 11/22* (2013.01); *H01B 13/01263* (2013.01)

(58) Field of Classification Search

CPC ..... H01B 3/02

See application file for complete search history.

(56) References Cited

U.S. PATENT DOCUMENTS

2015/0298978 A1* 10/2015 Park ..... C01B 32/19 156/760
2018/0374613 A1* 12/2018 Zymelka ..... H01B 1/026

FOREIGN PATENT DOCUMENTS

JP 2016-127429 A * 7/2016
KR 10-2012-0130390 A * 12/2012

* cited by examiner

*Primary Examiner* — Jeffry H Aftergut
(74) *Attorney, Agent, or Firm* — CIONCA IP Law P.C.; Marin Cionca

(57) ABSTRACT

Electrical cables and methods of forming such cables are disclosed, comprising a layer of a two dimensional material. In some embodiments, the cable is a subsea cable. In other embodiments, the cable may be an overhead power cable or a cable for forming electrical windings in a motor, generator or transformer. In some embodiments, the cable comprises a conductive core for carrying an electric current, and the layer of two dimensional material is disposed on the conductive core. In some embodiments, the subsea cable is a subsea power cable, umbilical cable or telecommunications cable. In some embodiments, the two dimensional material is configured to be superconducting or near-superconducting.

20 Claims, 5 Drawing Sheets

ELECTRICAL CABLES

CROSS-REFERENCE TO RELATED APPLICATIONS

This application is a continuation-in-part of U.S. Non-provisional application Ser. No. 15/779,812, filed May 29, 2018, which is a 371 of PCT/GB2016/053756, filed Nov. 30, 2016, which are hereby incorporated by reference, to the extent that they are not conflicting with the present application.

BACKGROUND OF INVENTION

1. Field of the Invention

The invention relates generally to electrical cables, more specifically to electrical cables which comprise graphene or other two-dimensional materials.

2. Description of the Related Art

Electrical cables are used to transfer electricity. These can range from large subsea power cables operating at high voltage (HV) and medium voltage (MV) together with distribution cables to small domestic cables. All of the power cables comprise a conductive core. It is advantageous for the conductivity of the cables to be enhanced as this prevents energy being lost to the environment. Additionally, copper, which is often used as the conductive core, is relatively expensive and it is therefore advantageous to limit the amount which has to be used.

Additionally, for larger cables, such as HV and MV distribution cables and subsea cables, the cable may comprise a sheath configured to provide a water barrier to protect the insulated core. The sheath is often made of material such as lead or a lead alloy and therefore significantly increases the mass of the cable. The sheath may also have a wire layer wound over it to assist in providing tensile strength to the cable as well as a physical armour. This armour wire layer is often composed of steel wires which may corrode and fail over time. It would therefore be advantageous to be able to provide lighter cables which were resistant to corrosion and have extended tensile abilities.

Telecommunication cables often comprise a conductive screen layer over the inner fibre optic package and high tensile steel wires providing the majority of the tensile strength of the cable, which includes the insulated core that carries the telecommunication signals. The conductive screen layer typically comprises copper. This screen provides electrical power but may corrode and fail over time. It would therefore be advantageous to be able to provide an electrical screen which is increased in tensile strength and is resistant to corrosion.

The present invention arises from the inventor's work in trying to overcome the problems associated with the prior art.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In accordance with a first aspect, there is provided a method of forming an electrical cable comprising a layer of a two dimensional material, the method comprising: forming a continuous layer of two dimensional material by mechanical exfoliation, wherein the continuous layer of two dimensional material is formed separately from a component of an electrical cable; and subsequently incorporating the continuous layer of two dimensional material onto a surface of the component of the electrical cable, using a continuous wrapping or continuous taping process.

In accordance with a second aspect, there is provided an electrical cable comprising a continuous layer of a two dimensional material wrapped or taped around a component of the electrical cable.

In accordance with a third aspect, there is provided a method of forming an electrical cable comprising a plurality of lengths of two dimensional material, the plurality of lengths comprising at least a first length of two dimensional material and a second length of two dimensional material, the method comprising: wrapping the first length of two dimensional material around a component of an electrical cable; at an end of the first length of two dimensional material, overlapping at least part of the end of the first length with at least part of an adjacent end of the second length of two dimensional material so as to create a region of overlap in which the first and second lengths are in contact with one another; and continuing to wrap the second length of two dimensional material around the component such that the second length of two dimensional material at least partly overwraps the region of overlap, thereby to hold said end of the first length in contact with said end of the second length.

In accordance with a fourth aspect, there is provided an electrical cable comprising: a plurality of lengths of two dimensional material wrapped around a component of the electrical cable, the plurality of lengths comprising at least a first length of two dimensional material and a second length of two dimensional material, wherein at least part of an end of the first length of two dimensional material is arranged to overlap at least part of an adjacent end of the second length of two dimensional material, so as to create a region of overlap in which the first and second lengths are in contact with one another, and wherein the second length of two dimensional material at least partly overwraps the region of overlap, thereby to hold said end of the first length in contact with said end of the second length.

In accordance with a fifth aspect, there is provided an electrical cable comprising a layer of a two dimensional material, hereinafter abbreviated to "2D material".

The term "2D material" can refer to a material consisting of a single layer of atoms.

An atom within the single layer of atoms may be covalently bonded to one or more other atoms within the single layer of atoms. However, an atom within the single layer of atoms may not be covalently bonded to a further atom with is not in the single layer of atoms. Accordingly, the 2D material may comprise a plurality of layers. The plurality of layers may be adjacent to each other. The plurality of layers may not be connected by covalent bonds.

A material may be considered to be two dimensional if it has a thickness of less than 50 nm, 40 nm, 30 nm or 20 nm, more preferably less than 10 nm, 7.5 nm, 5 nm or 2.5 nm, and most preferably less than 2 nm, 1.5 nm or 1 nm.

Various 2D crystalline and other nano-materials have recently been developed that display some very interesting properties. For instance, graphene is 200 times stronger than steel. It is a good conductor and can act as a barrier to corrosion.

Advantageously, the layer of the 2D material increases the tensile strength of the cable and protects the cable from corrosion.

The 2D material may be selected from the group consisting of graphene; stanene; boron nitride; niobium diselenide; tantalum (IV) sulphide; and magnesium diboride. In one embodiment, the 2D material is stanene. The stanene may comprise many-layer stanene, few-layer stanene or single-layer stanene. In an alternative embodiment, the 2D material is graphene. The graphene may comprise many-layer graphene, few-layer graphene or single-layer graphene. Preferably, the graphene comprises single-layer graphene.

In one embodiment, the cable comprises a subsea power cable.

The electrical power cable may comprise a conductive core. The conductive core may comprise aluminium or copper. Preferably, the conductive core comprises copper.

Preferably, the layer of the 2D material is disposed on a surface of the conductive core.

In some embodiments, the electrical cable may comprise a plurality of conductive cores. Each of the plurality of conductive cores may comprise a surface with a layer of the 2D material disposed thereon.

Advantageously, the electrical conductivity of the or each conductive core is enhanced. Accordingly, the or each conductive core may comprise a smaller cross-section than would be necessary in a prior art cable. Since less material is required the cost and mass of the electric cable per unit length is reduced.

The electrical cable may comprise a direct current (DC) subsea power cable or an alternating current (AC) subsea power cable. The subsea power cable may comprise a subsea umbilical cable.

The electrical cable may comprise a single conductive core or a plurality of conductive cores. Preferably, the or each conductive core is disposed adjacent to and surrounded by a semi-conducting inner screen or conductor screen. Preferably, the or each conductive core is surrounded by an insulating layer. Preferably, the or each insulating layer is disposed adjacent to the or each semi-conducting inner screen. Preferably, the or each insulating layer comprises polymeric insulation or paper insulation. Preferably, the or each conductive core is surrounded by a semi-conducting outer screen, or insulation screen. Preferably, the or each semi-conducting outer screen is disposed adjacent to the or each insulating layer.

In some embodiments, the electrical cable may form an electrical winding in a motor, generator, or transformer. The winding may also be referred to as a coil. In other embodiments, the electrical cable may comprise an overhead power cable.

The electrical cable may comprise a sheath, wherein the sheath surrounds the conductive core and is configured to physically protect the conductive core. In embodiments for use in subsea environments, the sheath may be configured to prevent the flow of water therethrough. Accordingly, the sheath may comprise an impermeable metallic hermetic barrier. The sheath may also be referred to as 'armouring', and a cable comprising a sheath for mechanical protection may be referred to as an armoured cable. In embodiments where the cable comprises a plurality of conductive cores one sheath may be configured to surround all of the plurality of cores. Alternatively or additionally, each of the plurality of cores may comprise a sheath. The sheath preferably comprises an impermeable metallic compound. The sheath may comprise a tape or foil. The sheath may comprise lead, a lead alloy, aluminium, an aluminium alloy, copper or a copper alloy.

The layer of the 2D material may be disposed on a surface of the sheath.

Advantageously, the layer of the 2D material increases the tensile strength of the sheath. Accordingly, the sheath may comprise less material than would be necessary in a prior art cable. Since less material is required the cost of the electrical cable and the mass of the electric cable per unit length is reduced. Alternatively, the sheath may comprise a similar amount of material to that used in the prior art but the cable would be able to withstand greater pressures.

The layer of the 2D material may be disposed on an internal surface of the sheath. However, in a preferred embodiment the layer of the 2D material is disposed on an external surface of the sheath. In a most preferred embodiment a layer of the 2D material is disposed on both the internal and external surfaces of the sheath.

Advantageously, the layer of the 2D material protects the sheath from corrosion.

In a preferred embodiment, the electrical cable comprises a conductive core with a first layer of the 2D material disposed on a surface thereof, and a sheath with a second layer of the 2D material disposed on a surface thereof.

The electrical cable may comprise an electrical shield or screen, wherein the electrical shield surrounds the conductive core and is configured to protect the conductive core from electrical interference. A cable comprising an electrical shield can be referred to as a shielded cable. The electrical shield acts as a Faraday cage, reducing the impact of external electrical interference on signals carried by the conductive core. The electrical shield can also reduce the strength of an external electromagnetic field generated by electrical currents carried by the conductive core, to reduce the impact of electromagnetic interference on nearby electrical equipment. In embodiments where the cable comprises a plurality of conductive cores each of the plurality of cores may comprise an electrical shield. The electrical shield may comprise metal wires and/or a metal foil. The metal wires or metal foil may comprise copper or aluminium.

The layer of the 2D material may be disposed on a surface of the electrical shield. In embodiments where the electrical shield comprises a metal foil the layer of the 2D material may be disposed on an internal surface of the metal foil. Alternatively, the layer of the 2D material is preferably disposed on an external surface of the metal foil. In a most preferred embodiment, a layer of the 2D material is disposed on both the internal and external surfaces of the metal foil.

In embodiments where the electrical shield comprises metal wires each of the metal wires may comprise a layer of the 2D material.

Advantageously, the layer of the 2D material increases the tensile strength of the electrical shield and protects the electrical shield from corrosion.

In a preferred embodiment, the electrical cable comprises a conductive core with a first layer of the 2D material disposed on a surface thereof, and an electrical shield with a second layer of the 2D material disposed on a surface thereof.

In a most preferred embodiment, the electrical cable comprises a conductive core with a first layer of the 2D material disposed on a surface thereof, an electrical shield with a second layer of the 2D material disposed on a surface thereof, and a sheath with a third layer of the 2D material disposed on a surface thereof. Preferably, the sheath surrounds the conductive core and the electrical shield.

The electrical cable may comprise a layer of wires configured to prevent any defects from occurring in the structure. The layer of wires may comprise a layer of steel wires. The steel wires may be coated with bitumen.

The steel wires may comprise galvanised steel wires. However, in a preferred embodiment each of the wires may comprise a layer of the 2D material. For example, the layer of the 2D material may be disposed on the surface of the wire, or may be an internal layer included within the wire.

Advantageously, the layer of the 2D material increases the tensile strength of the wires. Accordingly, less material can be used to achieve the same level of protection and the mass per unit length of the cable is reduced. The layer of the 2D material also protects the steel wires from corrosion. Accordingly, it is not necessary to use galvanised steel wires.

In an alternative embodiment, the electrical cable comprises a communications cable. Accordingly, the cable may comprise a subsea telecommunications cable.

The communications cable may comprise a plurality of fibre optic cores. The cores are preferably disposed within a tube. The tube may comprise a metallic or polymeric tube. The layer of the 2D material may be disposed on a surface of the tube.

Advantageously, the layer of the 2D material increases the tensile strength and resistance to corrosion of the tube.

The layer of the 2D material may be disposed on an internal surface of the tube. However, in a preferred embodiment the layer of the 2D material is disposed on an external surface of the tube. In a most preferred embodiment a layer of the 2D material is disposed on both the internal and external surfaces of the tube.

The communications cable may comprise a layer of metallic wires. The metallic wires may comprise high tensile metallic wires. The metallic wires preferably comprise steel wires. The layer of metallic wires may be disposed adjacent to the tube.

Preferably, the communications cable comprises at least two layers of metallic wires. Preferably, a first layer of metallic wires is disposed adjacent to the tube and a second layer of metallic wires is disposed adjacent to the first layer of metallic wires.

Advantageously, the or each layer of metallic wires afford protection to the tube and increase the tensile strength to the communications cable.

Each of the metallic wires may comprise a layer of the 2D material.

Advantageously, the layer of the 2D material increases the tensile strength of the metallic wires and protects the wires from corrosion. Since less material is required the cost of the communications cable and the mass of the communications cable per unit length is reduced.

The communications cable may comprise a conducting layer. The conducting layer is preferably disposed around the fibre optic cores. Preferably, the conducting layer is disposed around the tube in embodiments where this is present. Preferably, the conducting layer is disposed around the or each layer of metallic wires in embodiments where this is present. The conducting layer may comprise copper or aluminium. The layer of the 2D material may be disposed on a surface of the conducting layer.

Advantageously, the layer of the 2D material increases the tensile strength and conductivity of the conducting layer. Accordingly, the conducting layer may comprise less material than would be necessary in a prior art cable. Since less material is required the cost of the communications cable and the mass of the communications cable per unit length is reduced.

The layer of the 2D material may be disposed on an internal surface of the conducting layer. However, in a preferred embodiment the layer of the 2D material is disposed on an external surface of the conducting layer. In a most preferred embodiment a layer of the 2D material is disposed on both the internal and external surfaces of the conducting layer.

Advantageously, the layer of the 2D material protects the conducting layer from corrosion.

In a preferred embodiment, the communications cable comprises a plurality of fibre optic cores and a conductive layer with a first layer of the 2D material disposed on a surface thereof.

The communications cable may comprise a layer of further wires configured to prevent any defects from occurring in the structure. Preferably, the communications cable comprises a plurality of layers of further wires configured to prevent any defects from occurring in the structure. The or each layers of metallic wires may comprise a layer of steel wires. The steel wires may be filled with bitumen.

The steel wires may comprise galvanised steel wires. However, in a preferred embodiment, each of the wires may comprise a layer of the 2D material.

Advantageously, the layer of the 2D material increases the tensile strength of the wires. Accordingly, less material can be used to achieve the same level of protection and the mass per unit length of the cable is reduced. The layer of the 2D material also protects the steel wires from corrosion. Accordingly, it is not necessary to use galvanised steel wires.

In some embodiments of the invention, the two dimensional material may be configured to be superconducting or near-superconducting.

All features described herein (including any accompanying claims, abstract and drawings), and/or all of the steps of any method or process so disclosed, may be combined with any of the above aspects in any combination, except combinations where at least some of such features and/or steps are mutually exclusive.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
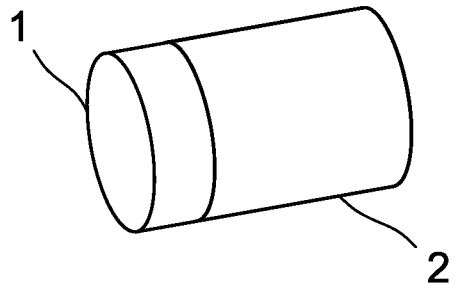
FIG. 1 is a schematic diagram of an electrical cable comprising a layer of two-dimensional material.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

FIG. 1 illustrates an electrical cable according to an embodiment of the present invention. The cable comprises a conductive core 1 and a layer of two-dimensional material 2, for example a layer of graphene. The layer of two-dimensional material 2 can provide various benefits to the electrical cable, such as increased electrical conductivity, corrosion resistance and tensile strength. The electrical cable may be configured to operate at any voltage. In some embodiments, the electrical cable can be configured to operate at low voltage (LV), medium voltage (MV), high voltage (HV), extremely high voltage (EHV), or supertension voltages. In some embodiments, the electrical cable may comprise a distribution cable or domestic cable. Examples of specific embodiments of the invention will now be described in detail.

Example 1: Subsea Power Cable

Figure 3:
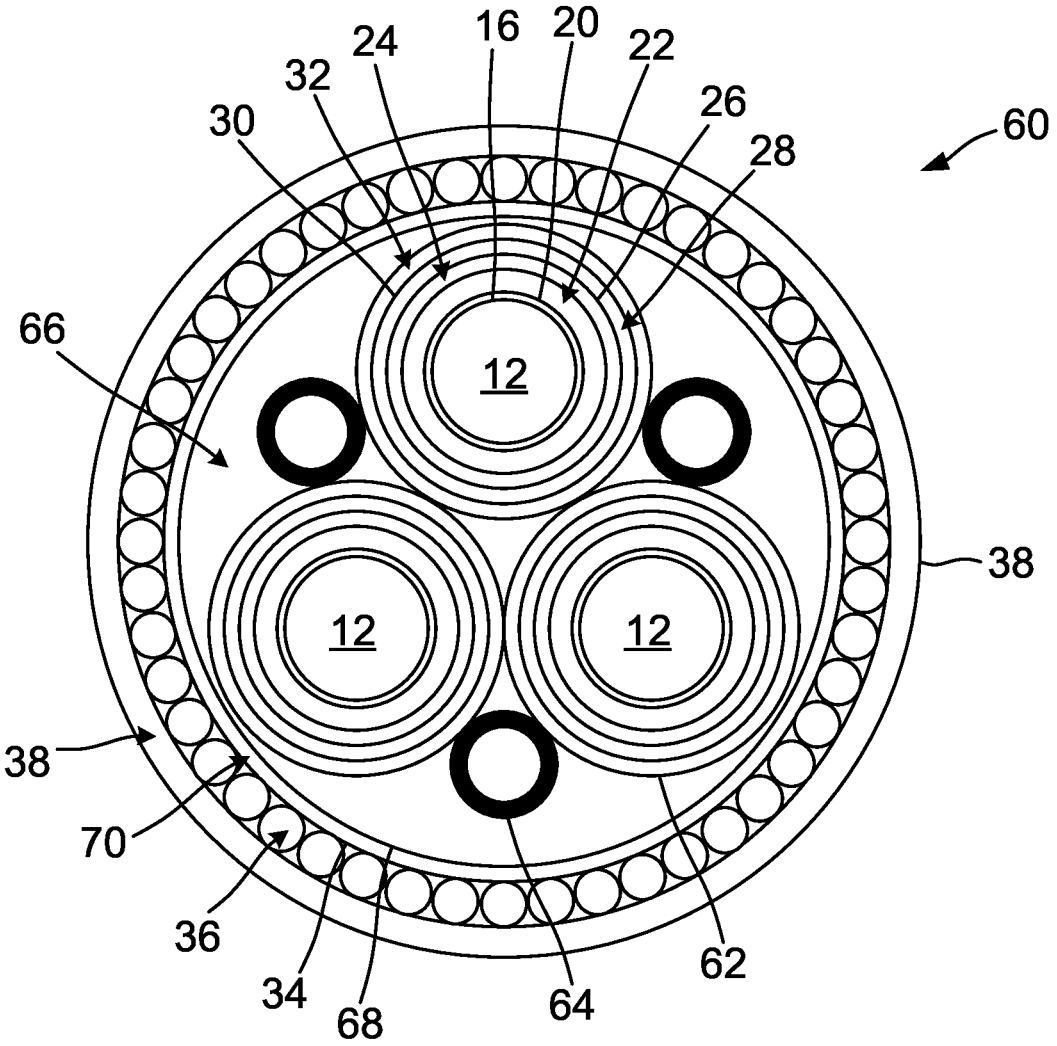
FIG. 3 is a cross-sectional view of an alternating current (AC) subsea power cable.

FIG. 3 shows a dry alternating current (AC) subsea power cable 60. The subsea power cable 60 comprises three core elements 62, each of which comprises an inner copper core 12 with a layer of a 2D material 16 disposed thereon. Immediately adjacent to the layer of the 2D material 16 there is disposed an inner semiconducting layer 20, which would typically comprise a carbon-loaded polyethylene or ethylene copolymer (such as ethylene vinyl acetate (EVA) and ethylene butyl acrylate (EBA)), or blends thereof. Adjacent the inner semiconducting layer 20, there is disposed an insulating layer 22 which may comprise cross-linked polyethylene, ethylene propylene rubber (EPR) or paper. The semiconducting layer 20 provides a degree of insulation for the insulating layer 22 from the conductive core 12 and the insulating layer 22 provides an insulating electrical barrier between the core 12 and the rest of the cable 18.

Adjacent the insulating layer 22, there is disposed an outer semiconducting layer, or insulation screen, 24, as with the inner semiconducting layer 20, this would typically comprise a carbon-loaded polyethylene or ethylene copolymer (such as ethylene vinyl acetate (EVA) and ethylene butyl acrylate (EBA)), or blends thereof. The purpose of the outer semiconducting layer 24 is to control the electrical stress levels within the cable and maintain a defined electric field within the insulating layer 22 and at value below that which would cause electrical breakdown of the insulating layer 22. It also allows safe discharge of any charge build-up within the insulation layer 22 when the cable 18 is switched off.

Adjacent to the outer semiconducting layer 24 of each core element 62 there is disposed a water blocking tape layer 26. If the cable 18 were to be damaged creating a defect therein the water blocking tape layer 26 is intended to swell upon contact with water which penetrates the cable 18, thereby preventing any water penetrating to the outer semiconducting layer 24, insulating layer 22, inner semiconducting layer 20, layer of the 2D material 16 and conductive core 12. While the water blocking layer 26 in the illustrated embodiment comprises a water blocking tape it will be appreciated that it could instead comprise a powder or gel type compound. Additionally, while not illustrated in FIG. 3, in some embodiments of the invention a water blocking layer can be included within the conductors to restrict water progress up the conductor strands. For example, a water blocking layer could be provided adjacent to the copper core 12 to restrict water progress up the core element 62.

Adjacent the water blocking tape layer 26, there is disposed an inner sheath 28 which would typically comprise lead, a lead alloy, aluminium, an aluminium alloy, copper or a copper alloy. The inner sheath 28 is provided to try and prevent any defects penetrating to the water blocking tape layer 26. The inner sheath 28 can act as an armouring layer to protect the internal components of the cable from mechanical damage. The inner sheath 28 may have been formed due to a solid extrusion or continuously welded for a "Dry cable". Alternatively, the inner sheath 28 may have been formed from a flat extrusion of foil or tape where the extrusion was then wrapped around the water blocking tape layer 26 and bonded for a "Semi dry cable". An additional layer of the 2D material 30 is disposed on the external surface of the inner sheath 28.

The additional layer of the 2D material 30 protects the inner sheath 28 from corrosion and significantly increases the tensile strength of the inner sheath 28. Accordingly, the cable 60 is stronger and could be used at greater depths. Alternatively, a thinner inner sheath 28 could be used to achieve the same strength resulting in a cable 60 which is cheaper to produce and has a reduced the mass per unit length.

In the illustrated embodiment the additional layer of the 2D material 30 is disposed on the outer surface of the inner sheath 28. However, it will be appreciated that a layer of the 2D material could be disposed on the inner surface of the inner sheath 28. This could be in addition to or instead of the layer of the 2D material 30 disposed on the outer surface of the inner sheath 28. The layer of the 2D material disposed on the inner surface of the inner sheath 28 would increase the tensile strength of the inner sheath 28 but would not protect the inner sheath 28 from corrosion.

Immediately adjacent the additional layer of the 2D material 30 there is disposed an outer sheath 32, which would typically comprise medium or high density polyethylene (MDPE or HDPE), polypropylene (PP) and/or poly (oxymethylene). The outer sheath 32 is provided to prevent the inner sheath 30 from being exposed to water and thereby further protects the inner sheath 30 from corrosion.

In addition to the three core elements 62 the subsea power cable 60 can comprise a number of optical fibre units 64. The core elements 62 and optical fibre units 64 are disposed in a filler package 66.

The filler package 66 comprising the core elements 62 and optical fibre units 64 is surrounded by a layer of binder tape 68. Adjacent the binder tape layer 68 is a layer of copper or brass tape 70. This layer is configured to protect the cable against boring marine organisms such the teredo, pholads and limnoria, and is often referred to as the anti-teredo layer 70. Adjacent to the anti-teredo layer 70 is disposed a bedding layer 34, and adjacent the bedding layer 34 there is disposed a layer of galvanised steel wires 36. As described above, each of the steel wires has a layer of graphene disposed on its surface. Since the outer layer of steel wires 36 in a subsea power cable are the main contributor of tensile strength to the cable, adding a layer of graphene or other two-dimensional material to the steel wires 36 as in the present embodiment can significantly increase the overall tensile strength of the cable. Finally, an external jacket layer 38 is provided which typically comprises a water permeable yarn cladding made of polypropylene. The external jacket layer 38 is provided to assist the bedding layer 34 in holding the layer of galvanised steel wires 36 in place.

While only a dry AC subsea power cable 60 is illustrated it will be appreciated that wet and semi-dry cables can also be used. A wet cable would be as described above but the cable elements 62 would not comprise a water blocking metallic tape layer 26, an inner sheath 28, an additional layer of the 2D material 30 or an outer sheath 32. Instead, the insulating layer 22 comprises a material configured to retard water tree growth therein.

Similarly, a semi-dry cable would be as described above but instead of comprising a water blocking layer 26, an inner sheath 28, an additional layer of the 2D material 30 or an outer sheath 32 each cable element 62 would comprise an overlapping tape or foil laminate layer adjacent to the outer semiconducting layer 24. The overlapping tape or foil laminate layer would be configured to provide an intermediate level of water blocking. A layer of 2D material could be provided on the overlapping tape or foil laminate layer to increase the tensile strength of this layer and protect it from corrosion.

Figure 2:
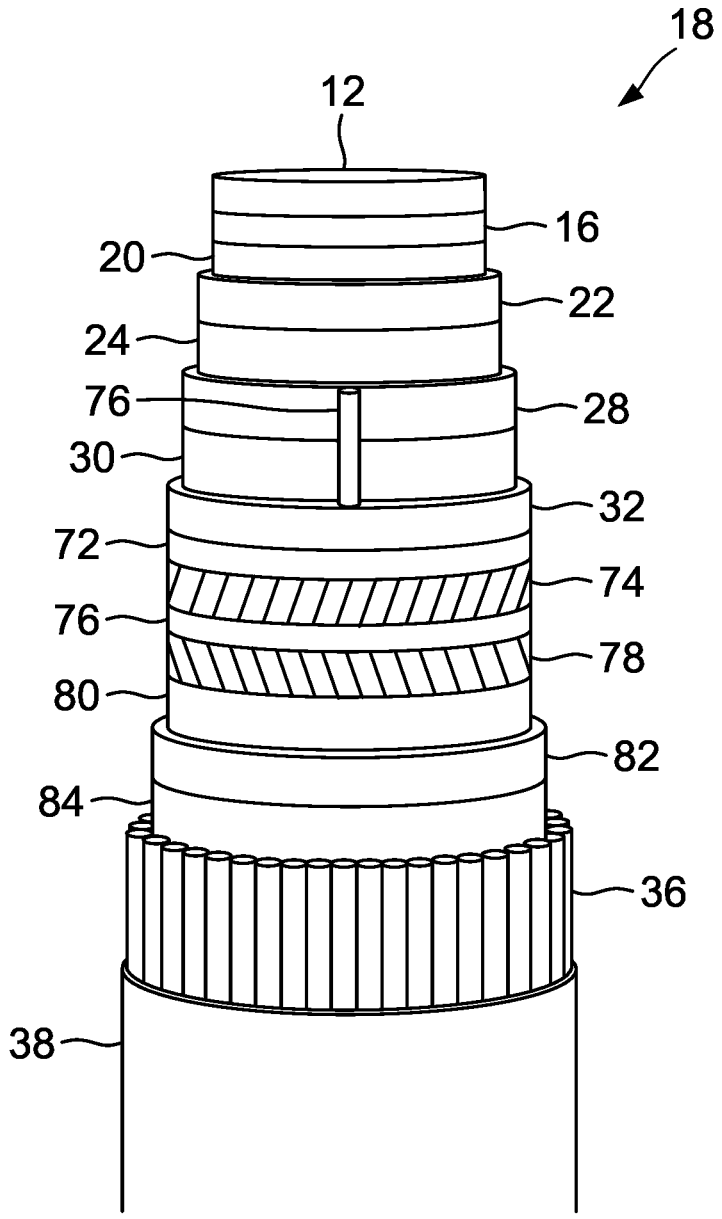
FIG. 2 is a schematic diagram of a direct current (DC) subsea power cable.

FIG. 2 shows a direct current (DC) subsea power cable 18. The subsea power cable 18 comprises a single inner copper core 12 with a layer of a two dimensional material 16 disposed thereon. Similar to the AC subsea power cable 60, the DC subsea power cable comprises an inner semiconducting layer 20, an insulating layer 22 and an outer semiconducting layer 24.

Adjacent to the outer semiconducting layer 24 there is disposed an inner sheath 28, with an additional layer of the two dimensional material 30 is disposed on the external surface of the inner sheath 28. Immediately adjacent the additional layer of the two dimensional material 30 there is disposed an outer sheath 32. A fibre optic cable unit 64 is disposed between the additional layer of the two dimensional material 30 and the outer sheath 32.

Adjacent the outer sheath 32 there is disposed a bedding layer 72, and adjacent the bedding layer 72 there is disposed a first layer of copper wires 74 which are wound around the first bedding layer to form a helix. A layer of graphene is disposed on the surface of each of the copper wires. This increases the conductivity, tensile strength and corrosion resistance of the wires. Accordingly, less copper can be used than would be necessary in a prior art cable leading to a cost saving and reduced mass per unit length.

Adjacent the first layer of copper wires is a bedding layer 76 and a second layer of copper wires 78 which are wound around the bedding layer 76 in the opposite direction to the first layer of copper wires 74 to form a further helix. A layer of graphene is disposed on the surface of each of the copper wires as described above. The two layers of copper wires 74, 78 form an integrated return conductor and are configured to protect the core 12 from electrical interference. Alternatively, or additionally, a layer of copper foil could be used.

Adjacent to the second layer of copper wires 78 is a bedding layer 80 and then a further insulating layer 82 configured to electrically insulate the integrated return conductor. Adjacent the further insulating layer 82 is a bedding layer 84, which is adjacent to a layer of galvanised steel wires 36. As described above, each of the steel wires has a layer of graphene disposed on its surface. Since the outer layer of steel wires 36 in a subsea power cable are the main contributor of tensile strength to the cable, adding a layer of graphene or other two-dimensional material to the steel wires 36 as in the present embodiment can significantly increase the overall tensile strength of the cable. Finally, an external jacket layer 38 is provided.

In some embodiments of the present invention, a layer of 2D material in a subsea power cable may be configured to act as a superconductor in a certain temperature range. For example, a layer of graphene can be made superconducting or near-superconducting by coating with a layer of lithium or by doping the graphene layer with calcium atoms. By 'near-superconducting', it is meant that the 2D material exhibits an extremely low, but finite, electrical resistance. By using a superconducting or near-superconducting layer of 2D material, the copper core can be reduced in size or even omitted altogether, leading to a significant reduction in the physical size and mass per unit length of the subsea cable. Furthermore, the superconducting or near-superconducting 2D material can also avoid the voltage drop associated with conventional subsea cables. For example, the maximum length of an alternating current (AC) subsea power cable operating at 132 kilovolts (kV) is currently limited to roughly 80 kilometres (km), due to the voltage loss in the cable. By utilising a superconducting or near-superconducting layer of 2D material as described above, embodiments of the invention may enable a significant increase in AC system length, potentially to several thousands of km.

Example 2: Subsea Telecommunication Cable

Figure 4:
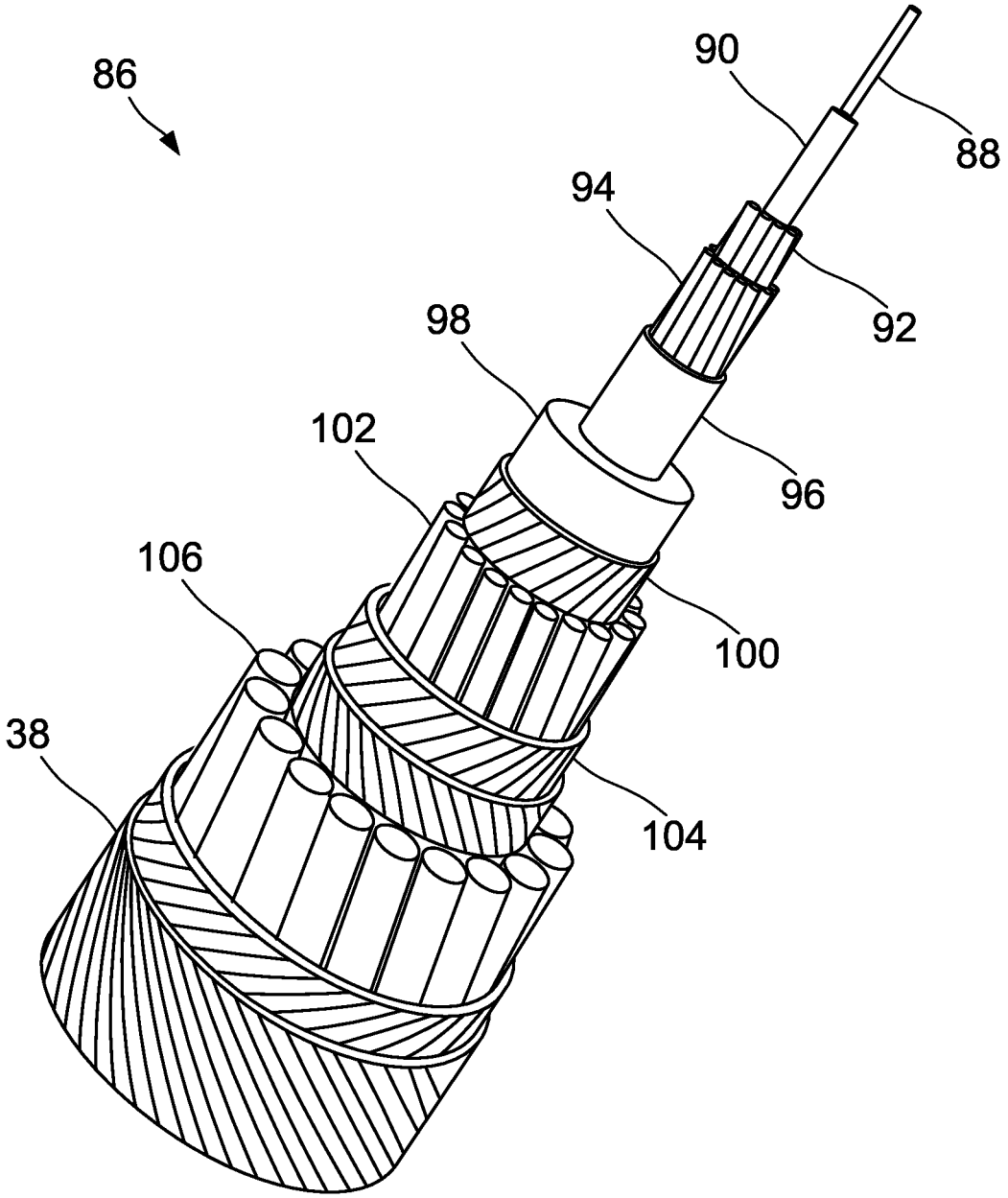
FIG. 4 is a subsea telecommunication cable.

FIG. 4 shows a subsea telecommunication cable 86. The cable 86 comprises a plurality of fibre optic cores 88 disposed in a tube 90. The tube 90 can comprise a metallic or plastic tube.

Adjacent to the tube 90 is a first layer of high tensile wires 92 and then a second layer of high tensile wires 94. In both cases, the high tensile wires 92, 94 may comprise steel and are configured to physically protect the core. The high tensile wires 92, 94 each comprise a layer of graphene on their surface which increases the tensile strength of the wires meaning that less steel can be used when compared to prior art cables. In subsea telecommunication cables, the primary contributor to tensile strength is the high tensile wires 92, 94 that surround the inner cable package. The graphene layer included in the high tensile wires 92, 94 in the present embodiment therefore increases the overall tensile strength of the subsea telecommunication cable. In other embodiments, a 2D material other than graphene may be used.

Adjacent to the second layer of high tensile wires 94 is a conductor layer 96. In a long repeatered cable system a direct current of around 8 kV is applied to the conductor layer 96 to provide power for repeaters which are placed at intervals in the order of 80 km apart. The conductor layer 96 which comprises copper with a layer of graphene disposed thereon. The graphene advantageously increases the conductivity of the conductor layer 96. Adjacent the conductor layer 96 is an insulating layer 98.

Adjacent the insulating layer 98 is a bedding layer 100, which is adjacent to a layer of galvanised steel wires 102, there is then a further bedding layer 104 and layer of galvanised steel wires 106 followed by an external jacket layer 38. The steel wires in both layers 102, 106 comprise a layer of graphene disposed on their surfaces to increase their tensile strength and corrosion resistance.

As in the first example, in some embodiments of the present invention a layer of 2D material in a subsea telecommunication cable may be configured to act as a superconductor in a certain temperature range, thereby enabling a reduction in size and mass of the copper core and the cable as a whole.

Example 3: Subsea Umbilical Cables

Subsea umbilical cables are typically custom made with specific cores rated for specific requirements and bundled together in the umbilical package. They are typically laid up with sub-component power cables, fibre optic cables, hydraulic pipes, strength members, water blocking and armour layers as required.

It will be appreciated that the present invention could be applied to a subsea umbilical cable by providing a layer of a two dimensional material, such as graphene, on the conductor, strength members and/or armour layers.

As in the first and second example, in some embodiments of the present invention a layer of 2D material in a subsea umbilical cable may be configured to act as a superconductor in a certain temperature range, thereby enabling a reduction in size and mass of the conductor and the cable as a whole.

Example 4: Overhead Power Cables

Overhead power cables are well known in the art and can be constructed and laid up in a number of ways. Some common examples of overhead power cables comprise an all aluminium alloy conductor (AAAC), an aluminium conductor alloy reinforced (ACAR), an aluminium conductor steel reinforced (ACSR) or a gap type aluminium conductor steel reinforced (GTACSR).

It will be appreciated that the present invention could be applied to an overhead power cable by providing a layer of a two dimensional material, such as graphene, on the conductor, which will improve the electrical conductivity thereof. Accordingly, less material can be used to achieve the same level of conduction and the mass per unit length of the cable is reduced. The overhead cable will also benefit from increased tensile strength and improved corrosion resistance.

By utilising a layer of 2D material in an overhead power cable, embodiments of the present invention can allow electrical power to be distributed at higher currents than are possible with conventional overhead power cables, for a given power transmission, resulting in a corresponding reduction in voltage. By enabling a lower voltage to be used, the size of the towers or pylons used to carry the overhead power cables can be reduced, since the distance between adjacent cables can be reduced. Alternatively, such embodiments could allow existing towers to be operated at lower voltages but with much higher current and power carrying capacity.

Example 5: Electric Motors and Generators

Figure 5:
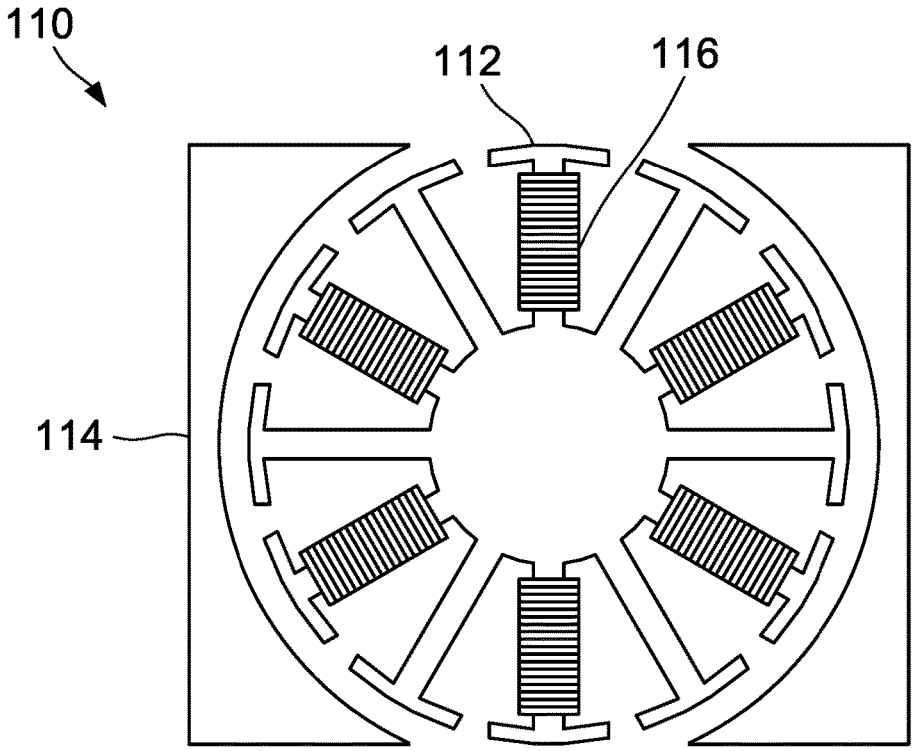
FIG. 5 is a schematic diagram of apparatus for use as an electric motor or generator.

FIG. 5 shows apparatus for use as an electric motor or an electric generator, according to an embodiment of the present invention. The principles of operation of electric motors and generators are well understood, and a detailed description will not be provided here so as to avoid obscuring the present inventive concept. In brief, in the present embodiment the apparatus 110 comprises a rotor 112 comprising a plurality of arms, a stator 114 formed from a permanent magnetic material, and a plurality of electrical windings 116 around the arms of the rotor 112. When used as an electric motor, the rotor 112 can be driven to rotate by passing electrical current through the electrical windings 116, which may also be referred to as coils. When used as a generator, an electric current can be induced in the electrical windings 116 by using an external force to drive rotation of the rotor 112. In other embodiments, the rotor 112 may be formed of the permanent magnetic material, and the electrical windings 116 may be provided in the stator 114.

In embodiments of the present invention, the cable from which the electrical windings are formed in a motor or generator, such as the one shown in FIG. 5, can comprise an electrical cable which comprises a layer of 2D material, such as the one shown in FIG. 1. For example, the cable which forms the electrical windings may comprise a layer of graphene. The 2D material, for example graphene, can increase the electrical conductivity of the cable used to form the windings, and consequently the current-carrying capacity of the windings is increased. Accordingly, the mass of the conductive core, for example a copper core, can be reduced, thereby decreasing the mass of the apparatus and improving its efficiency.

It will also be appreciated that the above-described benefits can be obtained when a cable such as the one shown in FIG. 1 is used to form electrical windings in other types of apparatus, such as transformers.

Example 6: Manufacture

In all of the above examples, the layer of the 2D material can be grown directly onto the surface of the component on which it is to be used, or can be fabricated separately and subsequently attached or wrapped to the surface. For example, a layer of 2D material can be grown directly on the surface of a substrate using (vacuum) vapour deposition, centrifugal atomisation/deposition, or (electro) plating, or can be fabricated separately using a suitable method, for example mechanical exfoliation or sintering, and subsequently attached to the surface of the component by a continuous wrapping/taping process.

In some embodiments, the layer of 2D material may be formed on the surface of a non-conducting substrate, for example a polymer substrate. The substrate may comprise a thread, monofilament or sheet of material, thereby allowing the layer of 2D material formed on the surface of the substrate to be easily handled during the cable manufacturing process. For example, when a layer of 2D material is provided on the surface of a thread or monofilament, the layer of 2D material can be incorporated into the electrical cable using conventional cable manufacturing techniques, similar to the process by which the conducting cores or steel reinforcing wires are incorporated into a conventional cable.

Example 7: Manufacturing with Continuous Layer of 2D Material

Figure 6:
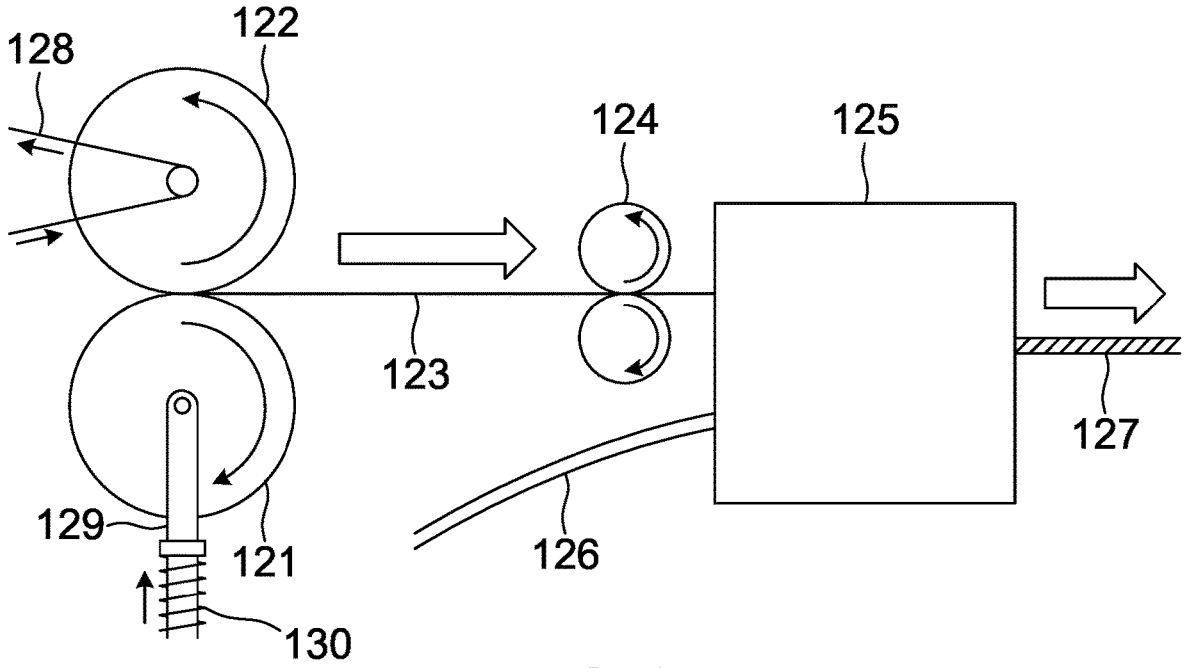
FIG. 6 is a schematic diagram of apparatus for manufacturing a cable comprising a continuous layer of 2D material.

Referring now to FIG. 6, apparatus for manufacturing a cable comprising a continuous layer of 2D material is illustrated, according to an embodiment of the present invention. The apparatus comprises a first rotating body 121 of precursor material from which a layer of 2D material can be formed by mechanical exfoliation. The apparatus further comprises a second rotating body 122 arranged to rotate in an opposite direction to the first rotating body 121. The second rotating body 122 has an adhesive surface, such that when the second rotating body 122 rotates in contact with the first rotating body 121, the adhesive forces between the surfaces of the first and second rotating bodies 121, 122 cause a continuous layer of 2D material 123 to be exfoliated from the surface of the first rotating body 121, as shown in FIG. 6.

In the present embodiment the first rotating body 121 is in the form of a solid cylinder, but in other embodiments the first rotating body 121 may take different forms, for example a hollow drum or tube. In the present embodiment, the first rotating body 121 comprises a cylinder of graphite as the precursor material, from which a layer of graphene can be formed by mechanical exfoliation. It will be appreciated that in other embodiments the first rotating body 121 may be formed of a material other than graphite, so as to produce layers of different 2D materials.

The continuous layer of 2D material 123 that is produced in this manner can then be incorporated into a cable using any suitable manufacturing technique, for example as described above in Example 6. In the present embodiment, the continuous layer of 2D material 123 is fed into a cable wrapping stage 125. The cable wrapping stage 125 also receives a component 126 of the cable, for example a conductive core, and wraps the component 126 in the continuous layer of 2D material 123. The cable wrapping stage 125 may use any suitable wrapping or taping process to combine the continuous layer of 2D material with the component 126 to be wrapped. The output of the cable wrapping stage 125 is a wrapped cable component 127, comprising the component 126 wrapped with the layer of 2D material 123.

The apparatus may comprise one or more supporting rollers 124 through which the continuous layer of 2D material 123 may pass before reaching the cable wrapping stage 125. The one or more supporting rollers 124 may assist in keeping the continuous layer of 2D material 123 taut as it is exfoliated from the surface of the first rotating body 121, and thereby support the continuous layer of 2D material to prevent it from sagging and potentially becoming wrapped around the first or second rotating bodies 121, 122 and/or caught in other equipment. In some embodiments, the one or more supporting rollers 124 could be omitted, for example, depending on the distance between the first and second rotating bodies 121, 122 and the cable wrapping stage 125.

Furthermore, in some embodiments the cable wrapping stage 125 may be omitted, and the continuous layer of 2D material 123 may instead be collected in a suitable form for storage, for example by wrapping the continuous layer of 2D material 123 around a bobbin or folding the continuous layer of 2D material 123 in a zig-zag pattern to create a stack of the continuous layer.

The apparatus further comprises a driving mechanism for causing one or both of the first and second rotating bodies 121, 122 to rotate. Depending on the embodiment, both of the first and second rotating bodies 121, 122 may be actively driven to rotate by the driving mechanism, or only one of the first and second rotating bodies 121, 122 may be driven by the driving mechanism and the other one of the first and second rotating bodies 121, 122 may be arranged to freely rotate while in contact with the other body 121, 122.

In the present embodiment, the driving mechanism 128 is configured to drive the second rotating body 122, while the first rotating body 121 is arranged to freely rotate while in contact with the second rotating body 122. This arrangement ensures that the two bodies naturally rotate at the same speed, helping to reduce shear forces at the contact point between the first and second rotating bodies 121, 122.

It will also be appreciated that as the layer of 2D material 123 is exfoliated from the surface of the first rotating body 121, over time the diameter of the first rotating body 121 will decrease as material is removed. Accordingly, the apparatus may further comprise an adjustment mechanism 129, 130 for urging the first and second rotating bodies 121, 122 against one another, so as to maintain physical contact between the first and second rotating bodies 121, 122 as material is removed from the first rotating body 121. In this way, the adjustment mechanism can ensure that a continuous layer of 2D material is produced, by maintaining contact between the first and second rotating bodies 121, 122 at all times.

The adjustment mechanism 129, 130 may take any suitable form. In the present embodiment a passive adjustment mechanism is provided, comprising a moveable arm 129 to which the first rotating body 121 is connected by a pivot, and a sprung member 130 configured to exert a force on the moveable arm 129 that urges the arm 129 and the pivot towards the second rotating body 122.

However, it will be appreciated that the above-described embodiment is just one example of how a suitable adjustment mechanism may be implemented. In other embodiments, an alternative form of adjustment mechanism may be provided. For example, in some embodiments an active adjustment mechanism may be used. An example of one such active adjustment mechanism comprises an actuator that is controllable to move the first rotating body 121 towards the second rotating body 122, and a feedback mechanism configured to monitor the diameter of the first rotating body 121 and control the actuator to move the first rotating body 121 towards the second rotating body 122 as the diameter reduces.

Furthermore, although in the above-described examples of the adjustment mechanism it is the first rotating body 121 that is caused to move, in other embodiments the second rotating body 122, or both the first and second rotating bodies 121, 122, may be moved by the adjustment mechanism.

Apparatus such as that illustrated in FIG. 6 can therefore be used to produce a cable in which one or more components of the cable are wrapped in a continuous layer of 2D material. By wrapping a continuous layer of 2D material in this way, the 2D material can be incorporated without the need for other materials such as adhesives, polymers and so on, which could otherwise degrade the performance of the resulting cable. For example, in the case of an electrical cable comprising a continuous layer of electrically conductive 2D material such as graphene, the continuous nature of the layer of 2D material (i.e. without any joins or gaps along its length) ensures that the resulting wrapped cable component exhibits a high conductivity, low resistance and low capacitance. This in turn can allow the electrical cable to carry an electrical current over long distances, for example tens or hundreds of kilometres, with relatively little power loss.

Example 8: Manufacturing with Multiple Separate Lengths of 2D Material

Figure 7A:
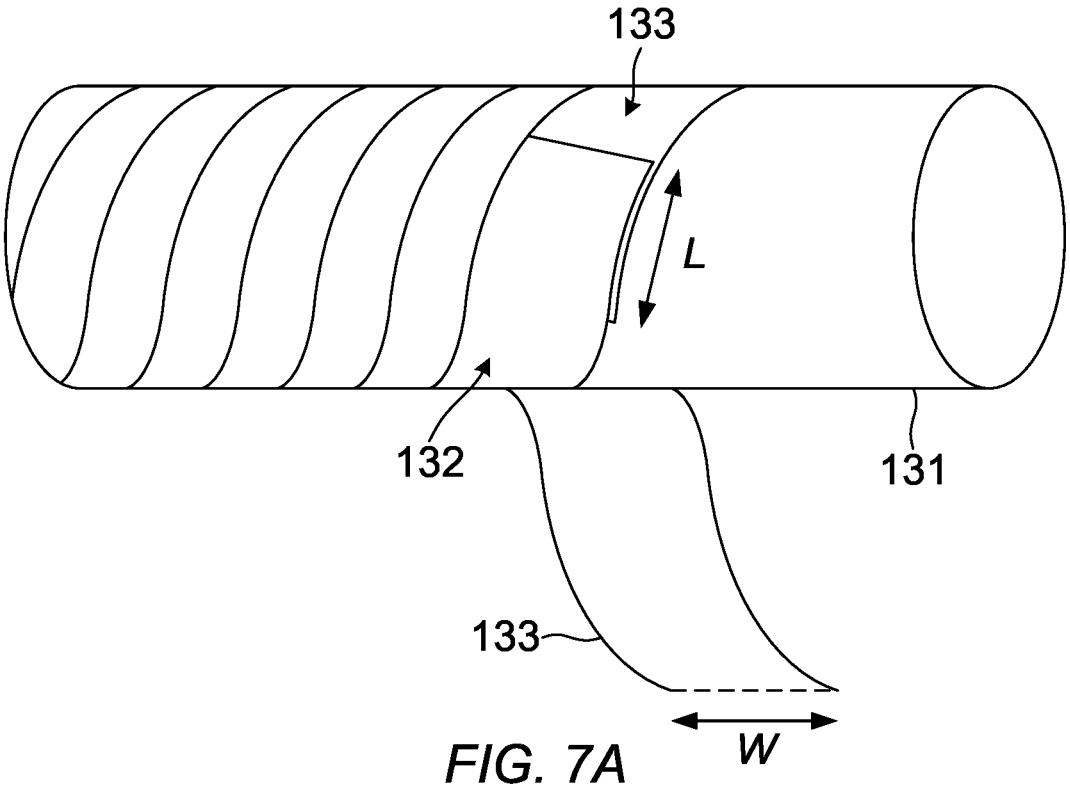
FIGS. 7A and 7B illustrate a process of wrapping a component of a cable in multiple separate lengths of 2D material.
Figure 7B:
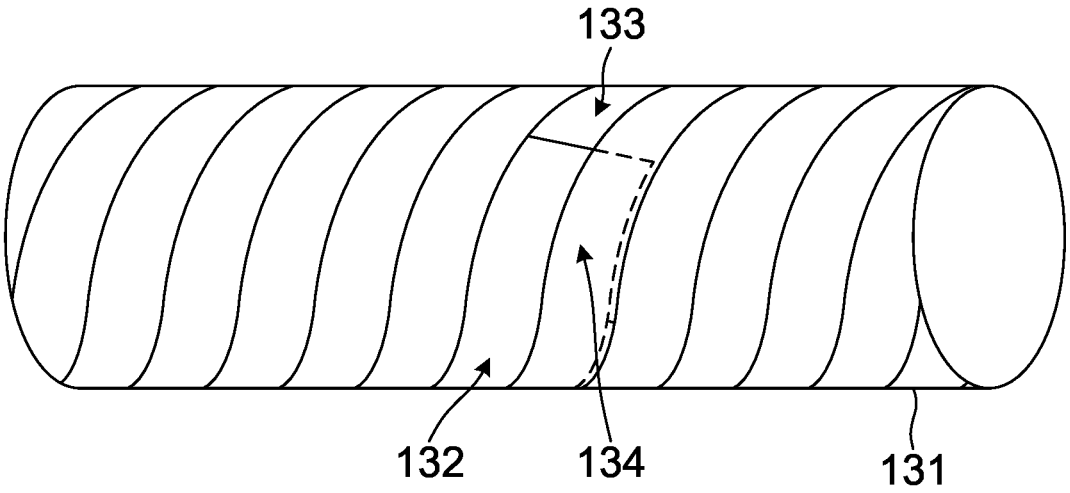

Referring now to FIGS. 7A and 7B, an example of a manufacturing process is illustrated by which a component of a cable can be wrapped with a plurality of physically separate lengths of 2D material, according to an embodiment of the present invention. In this embodiment, a plurality of physically separate lengths of 2D material 132, 133 are wrapped around a component 131 of a cable, for example a conductive core, using a wrapping or taping process.

As shown in FIG. 7A, at the end of a first length 132 of 2D material, the next length 133 of 2D material (i.e. a second length) is partially overlapped with the first length 132. This produces an area of overlap of size L×W, where L is the length by which the first and second lengths 132, 133 are overlapped, and W is the width of the 2D material (or the width of the narrower of the two lengths of material, if the widths are different).

In the present embodiment, the first length 132 of 2D material is arranged so as to overlie the second length 133 of 2D material, which may help to hold the end of the second length 133 in place as the second length 133 starts to be wrapped around the component 131. However, in another embodiment the second length 133 may be arranged to overlap the first length 132. If necessary, the end of the second length 133 and/or the end of the first length 132 may be temporarily secured in place against the surface of the component 131 while the wrapping process continues, for example by temporarily clamping the end(s) of the first and/or second lengths 132, 133 against the component 131.

As shown in FIG. 7B, as the wrapping process continues, each part of the length of 2D material is arranged to at least partly overlie part of the 2D material that was previously wrapped around the component 131. This may be referred to as 'overwrapping' a preceding part of the length of 2D material that has already been wrapped around the component 131. In this way, each time the length of 2D material is wrapped once around the circumference of the component 131, an underlying adjacent part of the length of 2D material is overwrapped and thereby compressed against the surface of the component 131 so as to be tightly held in place. At the point where the end of the first length 132 and the end of the second length 133 are overlapped, this results in an area in which at least part of the overlapped ends are overwrapped by the next part of the second length 133, such that the overlapped ends of the first and second lengths 132, 133 are held in contact with one another by the overwrapped part of the second length 133, as shown by the shaded area 134 in FIG. 7B.

By overlapping the ends of the first and second lengths 132, 133 of 2D material in this way, to create an area of overlap, and then overwrapping the second length 133 on top of at least part of the area of overlap as shown in FIGS. 7A and 7B, physically contact between the first and second lengths 132, 133 can be maintained in the final wrapped component 131 without the need for additional materials such as adhesive, solder, and so on. This can be particularly advantageous in embodiments in which the electrical properties of the 2D material is utilised, for example in the case of an electrical cable comprising a layer of electrically conductive 2D material such as graphene. In such embodiments, if separate pieces of 2D material were incorporated with the inclusion of other materials such as polymer-based adhesives, the presence of the other material(s) may induce undesired effects such as an increased capacitance.

Hence, it is advantageous to be able to incorporate multiple separate lengths of 2D material into a cable in such a way that physical and electrical contact between the separate lengths is maintained, without the need for adhesive or other materials. Furthermore, a manufacturing process such as the one described here with reference to FIGS. 7A and 7B can provide many of the benefits of a cable having a continuous layer of 2D material, such as the one produced by the apparatus shown in FIG. 6, but without the need to produce a single continuous layer of 2D material of sufficient length to wrap the entire component 131.

Example 9: Overwrapping Graphene Layers with Angular Offset

Embodiments of the invention have been described above in which a layer of 2D material such as graphene can be wrapped around a component of a cable, for example using a continuous wrapping or continuous taping process. In some such embodiments a second layer of graphene may be overwrapped on top of a first layer of graphene around the component, with the wrapping angles of the first and second layers of graphene controller such that an angular offset exists between the first and second layers, in terms of corresponding crystallographic axes of the graphene within each of the first and second layers. For example, the first and second layers of graphene may be wrapped around the component using any of the methods described above in Examples 6, 7 and 8. In some embodiments any number of additional layers may be overwrapped on top of the second layer of graphene, such that the cable may comprise any number of two or more layers of graphene overwrapped on top of one another. Depending on the embodiment, each of the first and second layers of graphene, and/or any additional layers of graphene, may be a single continuous layer as described above in Examples 6 and 7, or may be a plurality of separate lengths of graphene as described above in Example 8.

In some embodiments, the angular offset may be substantially equal to 1.1 degrees. In such embodiments, preferably the cable comprising the first and second layers of graphene with an angular offset of 1.1 degrees further comprises a cooling mechanism for cooling the first and second layers of graphene to a suitably low temperature to switch the first and second layers of graphene into a superconducting state. For example, the component around which the first and second layers of graphene are wrapped may be in the form of a hollow tube configured to carry a suitable cooling medium, such as liquid nitrogen or liquid helium. Alternatively, in some embodiments the cooling medium may be carried in a part of the cable other than the component around which the first and second graphene layers are wrapped.

The use of an angular offset substantially equal to 1.1 degrees between two or more layers of graphene has been shown to allow the graphene layers to be switched into the superconducting state at relatively high temperatures, for example liquid nitrogen temperatures.

CONCLUSION

In conclusion, a layer of a 2D material, such as graphene, deposited onto a material increases the electrical conductivity thereof dramatically. It also increases the tensile strength of the material and protects the material from corrosion.

Accordingly, electrical cables comprising a layer of a 2D material may be stronger, have a reduced mass per unit length and be cheaper to manufacture. These cables will also be more resistant to corrosion than prior art cables.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

Claim limitations should be construed as means-plus-function limitations only if the claim recites the term "means" in association with a recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

The invention claimed is:

1. A method of forming an electrical cable comprising a layer of a two dimensional material, the method comprising:

forming at least a first continuous layer of two dimensional material and a second continuous layer of two dimensional material by mechanical exfoliation, wherein the first and second continuous layers of two dimensional material are formed separately from a component of an electrical cable; and subsequently incorporating the first and second continuous layers of two dimensional material onto a surface of the component of the electrical cable, using a continuous wrapping or continuous taping process, wherein said continuous wrapping or continuous taping process comprises overwrapping the second continuous layer on top of the first continuous layer around the component, with respective wrapping angles of the first and second continuous layers being controlled such that an angular offset exists between the first and second continuous layers, said angular offset comprising an offset in corresponding crystallographic axes of the two dimensional material within each of the first and second layers.

2. The method of claim 1, wherein forming the continuous layer of two dimensional material comprises rotating a first body of material against a second body having an adhesive surface, such that the continuous layer of two dimensional material is exfoliated from a surface of the first body contacted by the second body.

3. The method of claim 2, comprising exerting a force on one of the first and second bodies so as to urge said one of the first and second bodies towards the other one of the first and second bodies, thereby to maintain physical contact between the first and second bodies as the continuous layer of two dimensional material is exfoliated from the surface of the first body.

4. The method of claim 1, wherein the component comprises a conductive core.

5. The method of claim 1, wherein the component comprises an electrical shield or screen surrounding a conductive core and configured to protect the conductive core from electrical interference.

6. The method of claim 1, wherein the two dimensional material is selected from the group consisting of graphene; stanene; boron nitride; niobium diselenide; tantalum (IV) sulphide; and magnesium diboride.

7. The method of claim 1, wherein in use, said angular offset causes the first and second continuous layers of two-dimensional material to act as a superconductor below a threshold temperature.

8. The method of claim 7, wherein said two-dimensional material comprises graphene, and said angular offset is substantially equal to 1.1 degrees.

9. An electrical cable comprising a first continuous layer of a two dimensional material and a second continuous layer of a two dimensional material wrapped or taped around a component of the electrical cable, wherein respective wrapping angles of the first and second continuous layers are arranged such that an angular offset exists between the first and second continuous layers, said angular offset comprising an offset in corresponding crystallographic axes of the two dimensional material within each of the first and second layers.

10. The electrical cable of claim 9, wherein in use, said angular offset causes the first and second continuous layers of two-dimensional material to act as a superconductor below a threshold temperature.

11. The electrical cable of claim 10, wherein said two-dimensional material comprises graphene, and said angular offset is substantially equal to 1.1 degrees.

12. A method of forming an electrical cable comprising a plurality of lengths of two dimensional material, the plurality of lengths comprising at least a first length of two dimensional material and a second length of two dimensional material, the method comprising:

wrapping the first length of two dimensional material around a component of an electrical cable;

at an end of the first length of two dimensional material, overlapping at least part of the end of the first length with at least part of an adjacent end of the second length of two dimensional material so as to create a region of overlap in which the first and second lengths are in contact with one another; and continuing to wrap the second length of two dimensional material around the component such that the second length of two dimensional material at least partly overwraps the region of overlap, thereby to hold said end of the first length in contact with said end of the second length, wherein the method comprises:

wrapping at least a third length of two dimensional material over the first and/or second length of two dimensional material, with respective wrapping angles of the third length and said first and/or second length being controlled such that an angular offset exists between adjacent layers of two-dimensional material in the third length and said first and/or second length, said angular offset comprising an offset in corresponding crystallographic axes of the two-dimensional material within the third length and said first and/or second length.

13. The method of claim 12, wherein the component comprises a conductive core.

14. The method of claim 12, wherein the component comprises an electrical shield or screen surrounding a conductive core and configured to protect the conductive core from electrical interference.

15. The method of claim 12, wherein the two dimensional material is selected from the group consisting of graphene; stanene; boron nitride; niobium diselenide; tantalum (IV) sulphide; and magnesium diboride.

16. The method of claim 12, wherein in use, said angular offset causes the two-dimensional material in the third length and said first and/or second length to act as a superconductor below a threshold temperature.

17. The method of claim 16, wherein said two-dimensional material comprises graphene, and said angular offset is substantially equal to 1.1 degrees.

18. An electrical cable comprising:

a plurality of lengths of two dimensional material wrapped around a component of the electrical cable, the plurality of lengths comprising at least a first length of two dimensional material and a second length of two dimensional material, wherein at least part of an end of the first length of two dimensional material is arranged to overlap at least part of an adjacent end of the second length of two dimensional material, so as to create a region of overlap in which the first and second lengths are in contact with one another, and wherein the second length of two dimensional material at least partly overwraps the region of overlap, thereby to hold said end of the first length in contact with said end of the second length wherein the electrical cable comprises:

at least a third length of two dimensional material wrapped over the first and/or second length of two dimensional material, with respective wrapping angles of the third length and said first and/or second length being arranged such that an angular offset exists between adjacent layers of two-dimensional material in the third length and said first and/or second length, said angular offset comprising an offset in corresponding crystallographic axes of the two-dimensional material within the third length and said first and/or second length.

19. The electrical cable of claim 18, wherein in use, said angular offset causes the two-dimensional material in the third length and said first and/or second length to act as a superconductor below a threshold temperature.

20. The electrical cable of claim 19, wherein said two-dimensional material comprises graphene, and said angular offset is substantially equal to 1.1 degrees.

* * * * *